US006665994B1

(12) United States Patent
Ruggeri

(10) Patent No.: US 6,665,994 B1
(45) Date of Patent: Dec. 23, 2003

(54) SELF-ALIGNING BUILDING BLOCKS

(76) Inventor: John Robert Ruggeri, 604 Stafford La., St. Augustine, FL (US) 32086

( * ) Notice: Subject to any disclaimer, the term of this patent is extended or adjusted under 35 U.S.C. 154(b) by 0 days.

(21) Appl. No.: 10/165,292

(22) Filed: Jun. 7, 2002

(51) Int. Cl.[7] ..... E04B 2/08

(52) U.S. Cl. ..... 52/592.6; 52/603; 52/604; 52/606

(58) Field of Search ..... 52/592.1, 592.6, 52/596, 604, 605, 606, 590.1, 603, 561

(56) References Cited

U.S. PATENT DOCUMENTS

| | | | | | |
|---|---|---|---|---|---|
| 221,127 | A | * | 10/1879 | Walker | 52/726.5 |
| 468,838 | A | * | 2/1892 | Steiger | 52/284 |
| 800,067 | A | | 9/1905 | Brooke | |
| 2,019,653 | A | | 11/1935 | Buyer | |
| 2,205,419 | A | | 6/1940 | Kraemer | |
| 2,861,388 | A | * | 11/1958 | Favaretto | 446/124 |
| 3,534,518 | A | | 10/1970 | Zagray | |
| 4,124,961 | A | * | 11/1978 | Habegger | 52/592.6 |
| 4,186,540 | A | | 2/1980 | Mullins | |
| 4,485,604 | A | * | 12/1984 | Palamara et al. | 52/436 |
| 4,731,279 | A | * | 3/1988 | Isshiki | 428/159 |
| 4,787,189 | A | | 11/1988 | Haug | |
| 4,802,318 | A | | 2/1989 | Snitovski | |
| 5,379,565 | A | * | 1/1995 | Vienne | 52/606 |
| 5,457,926 | A | | 10/1995 | Jensen | |
| 5,623,797 | A | | 4/1997 | Gravier | |
| 5,729,943 | A | * | 3/1998 | Cambiuzzi | 52/438 |
| 5,894,702 | A | | 4/1999 | Stenekes | |
| 5,899,040 | A | | 5/1999 | Cerrato | |
| 5,901,520 | A | | 5/1999 | Abdul-Baki | |
| 5,966,889 | A | * | 10/1999 | Zinner | 52/606 |
| 6,082,067 | A | * | 7/2000 | Bott | 52/592.3 |
| 6,122,881 | A | | 9/2000 | Aubertot | |
| 6,223,493 | B1 | | 5/2001 | Ruggeri | |
| 6,244,009 | B1 | * | 6/2001 | Cerrato | 52/604 |
| 6,295,778 | B1 | * | 10/2001 | Burt | 52/592.6 |
| 6,490,837 | B1 | * | 12/2002 | Dueck et al. | 52/592.6 |

* cited by examiner

*Primary Examiner*—Jeanette E. Chapman
(74) *Attorney, Agent, or Firm*—Thomas C. Saitta

(57) ABSTRACT

The invention is a self-aligning cementitious block and a wall system of such blocks stacked and joined by mortar to form a vertically oriented wall structure, where the block comprises alignment means which correctly align the block relative to the blocks upon which it is stacked such that the side walls are parallel to the side walls of the lower blocks. The alignment means comprise tongue members and groove members of corresponding configuration, where the tongue members preferably extend downward from the two end walls and the middle wall a distance below the lower edges of the side walls, and where the groove members are positioned on the tops of the end walls and middle wall, the groove members of inferior or lower blocks receiving the tongue members of a superior or upper block stacked thereupon. Starter blocks with a flat underside and corner blocks are also provided.

16 Claims, 4 Drawing Sheets

SELF-ALIGNING BUILDING BLOCKS

BACKGROUND OF THE INVENTION

This invention relates generally to the field of building blocks, usually formed of cementitious material, which are used as stacked components in the construction of walls and structures. More particularly, the invention relates to such articles which are shaped such that the blocks interlock or align when stacked.

Cementitious building blocks, often known as cement or concrete blocks, are well known in the masonry and construction fields. In the most common configuration, the blocks are rectangular with dimensions of approximately 8 inches in height and depth and 16 inches in length. The blocks are not solid but are provided with two vertically oriented openings separated by a lateral internal wall or web member, such that the blocks possess a shape similar to the number "8" with rectangular corners when viewed from the top or bottom. The open interiors reduce the weight of the block, allow less material to be consumed in their formation, and provide vertical channels in the finished wall structure for the passage of wiring, plumbing or conduits, or for receipt of filler materials such as poured concrete to increase strength, insulation or other properties. Such blocks have been in use for many years, and when properly joined by mortar interspersed between adjacent blocks they form extremely solid structures. Constructing a wall from discrete blocks requires a certain degree of skill, since wet mortar must be applied to the proper surfaces of the previously laid blocks and/or to the proper surfaces of the block to be laid, then the block must be positioned and aligned with the previously laid blocks such that the height of each row remains constant and such that the wall possesses a planar inner and outer surface.

Because the proper laying of block is a time-consuming, labor-intensive and skilled task, alternative block structures, configurations and systems have been developed which address one or more of these problems. One approach has been to provide mortarless blocks, i.e., blocks which interlock in a secure manner without the need for the addition of mortar or other bonding material between individual blocks. The blocks are usually constructed such that each possesses both male and female mating components, such as a pair of longitudinal channels on the top and a pair of longitudinal ridges on the bottom, so that the channels of the lower block receive the ridges of the block set above it. Other projection/recess or tongue/groove mating configurations are also known and utilized. Many systems use the interlocking blocks merely as forms to receive poured concrete, with the blocks often formed of polystyrene foam. Examples of such systems are seen in U.S. Pat. No. 5,901,520 to Abdul-Baki, U.S. Pat. No. 5,894,702 to Stenekes, U.S. Pat. No. 5,623,797 to Gravier et al., U.S. Pat. No. 5,457,926 to Jensen, U.S. Pat. No. 4,186,540 to Mullins, and U.S. Pat. No. 3,534,518 to Zagray. Mortarless systems have met with rather limited success, however, since conventional block-making equipment cannot produce blocks with less than a 1/16 inch variation in height between individual blocks. Even such a small variation is enough to cause unacceptable deviation from plumb after only 3 or 4 courses. The use of mortar between blocks compensates for this variation, since the height of the mortar can be varied to properly position each block at the proper height. Mortar also serves to seal joints and provides a measure of flexural strength, so eliminating mortar is not necessarily beneficial.

Other systems of interlocking or aligning blocks have been developed where mortar or grout is still used in some degree to join adjacent blocks in a more secure manner beyond that provided by the interlocking or aligning structures alone. For example, Brooke in U.S. Pat. No. 800,067 discloses blocks having longitudinal tongue and groove alignment means along the edges, where mention is made that cement or grout is utilized to construct the wall. Buyer in U.S. Pat. No. 2,019,653 shows blocks having centralized raised bosses and corresponding sockets for alignment, where the bosses sockets have a flat surface bounded by two sloping lateral surfaces, where the flat and sloping surfaces abut directly when the blocks are stacked. A recess is provided along the horizontal joint between courses for receiving mortar or grout after the blocks have been stacked. Finally, Huag et al. in U.S. Pat. No. 4,787,189 shows another type of interlocking blocks where the center of the blocks have longitudinal tongue and groove configurations. A problem with the Brooke and Huag et al. systems is that both still require skilled application of the mortar in the right amount to the proper locations, since there is no provision in the designs to allow for excess or misplaced mortar. Any mortar which inadvertently falls into the tongue and groove areas will interfere with and prevent proper alignment of the blocks, necessitating the lifting of the block and removal of the excess material. The Buyer system is in effect a mortarless system, with all the inherent problems of those types, since the mortar or grout is not applied until after the blocks have been stacked. Should the mortar be applied prior to stacking, the Buyer design likewise provides no margin for application error, since the sloped surfaces make direct contact when the blocks are stacked and excessive or misplaced mortar will interfere with the proper fit and alignment.

Another similar type of self-aligning building block system is disclosed in my U.S. Pat. No. 6,223,493 issued May 1, 2001. The invention therein is a self-aligning cementitious block and a wall system of such blocks stacked and joined by mortar to form a vertically oriented wall structure, where the block comprises alignment means which correctly align the block relative to the blocks upon which it is stacked such that the side walls are parallel to the side walls of the lower blocks. The alignment means comprise projection members and recess members of corresponding configuration, where the projection members preferably extend downward from the two end walls and the middle wall a distance below the lower longitudinal edges of the side walls, and where the recess members are positioned on the tops of the end walls and middle wall, the recess members of inferior or lower blocks receiving the projection members of a superior or upper block stacked thereupon. Starter blocks with a flat underside and corner blocks are also provided. Such a design for the blocks has been found to be difficult to manufacture, and the extended projection member is subject to breaking if mishandled. Furthermore, the design is more difficult to stack on a pallet in a compact manner.

It is an object of this invention to provide a cementitious building block and system where the blocks are self-aligning and interlock to provide a wall structure having generally planar inner and outer wall surfaces, where the courses are easily maintained at plumb as the height of the wall increases. It is a further object to provide such a block and system where the blocks can be properly stacked in a fast and non-complicated manner, such that the task can be performed by relatively unskilled labor having only the most basic of mortar application skills. It is a further object to provide such a system where mortar is utilized to join adjacent blocks, such that the joints are sealed, flexural strength is enhanced, and variations in block height can be compensated for. These and other objects not expressly stated will be apparent based on the disclosure and description of the invention, its best mode and preferred embodiment, as set forth below.

SUMMARY OF THE INVENTION

The invention is a self-aligning cementitious block and a system of such blocks stacked and joined by mortar to form a vertically oriented wall structure, where the block comprises alignment means which correctly align the block relative to the blocks upon which it is stacked such that the side walls are parallel to the side walls of the lower blocks. The alignment means comprise tongue members and groove members of corresponding configuration, where the tongue members extend downward from the two end walls and the middle wall a distance below the lower longitudinal edges of the side walls, and where the groove members are positioned on the tops of the end walls and middle wall, the groove members of inferior or lower blocks receiving the tongue members of a superior or upper block stacked thereupon.

The tongue members comprise a planar, horizontally disposed, lower edge bounded by a pair of short, outwardly inclined first sloping side walls, and a pair of short, outwardly inclined second sloping side walls connecting the first sloping side walls to the lower edges or bottom of the block. The groove members comprise a planar lower edge or bottom bounded by a pair of short, outwardly inclined first sloping side walls, and a pair of short, outwardly inclined second sloping walls connecting the first sloping side walls to the upper edges or top of the block. The second sloping side walls on both the tongue member and groove member are more sloped or inclined, i.e., more horizontally or less vertically disposed, than the first sloping side walls. The depth of the groove members is less than the vertical height or length of the tongue members, and the lateral width of the tongue members is slightly less than the width of the groove members, such that when a block is placed atop another block or set of blocks the tongue member sloping walls and groove member sloping walls loosely mate. The alignment means insure that the blocks are properly oriented and the mortar bonds the blocks together.

Corner blocks are provided in the system, the corner blocks being identical to the standard block in regard to the tongue members on the end walls and the middle wall, and to the groove members on one end wall and the middle wall. The opposing end wall is an exterior end wall and has a planar upper lateral edge rather than a groove member. A pair of groove members of identical configuration are positioned in the side walls of the block between the middle wall and the end wall with the planar upper lateral edge. To form a corner, each superior corner block is positioned perpendicular to the inferior corner block, such that the tongue members extending beneath the middle and exterior end walls of the superior block align with the groove members positioned in the side walls of the inferior block. In this manner the exterior end walls present a solid square surface to the outside of the corner in conjunction with the solid side walls of the standard blocks. Starter blocks having a planar lower surface with no tongue members are provided to form the first or base course of blocks.

In assembling the block wall structure, the worker applies mortar to either the upper edges of an inferior block or row of blocks or the lower edges of the block to be joined, as well as to the end wall of the adjacent block or the block to be joined. The worker sets the tongue members into the groove members, such that the block is correctly aligned relative to the inferior blocks and adjacent block. Any excess mortar placed into the joint recess is extruded outward by the weight of the block due to the combination of the first and second sloping side walls of the tongue and groove members, where it is easily removed, and any mortar mistakenly deposited in the groove members are on the tongue members will be expressed outwardly due to the chute effect created by the sloping side walls, thus preventing the excess mortar from interfering with proper alignment.

DETAILED DESCRIPTION OF THE INVENTION

With reference to the drawings, the invention will now be described in detail with regard for the best mode and the preferred embodiment. In general, the invention comprises blocks which are configured to self-align when stacked into a wall configuration so that each successive course or row of blocks is properly aligned with the lower course or row of blocks to provide generally planar front and back wall surfaces. The blocks are provided with alignment means comprising projection or tongue members and recess or groove members such that alignment occurs in a tongue-and-groove manner. As discussed herein, the tongue members are shown to be on the bottom of the block and the groove members are shown to be on the top of the block, but it is to be understood that this is purely a matter of engineering choice and the blocks can also be configured with the tongue members disposed on the top and the groove members on the bottom of the blocks, i.e., the blocks can be inverted. Specially configured corner blocks and starter blocks are provided to complete the system whereby right angle corner walls can be constructed. The blocks are joined by mortar or other bonding material to form the finished structure. It is preferred that the blocks be formed of a cementitious material, such as cement or concrete, but any material known in the industry which is structurally suitable for construction of building blocks to support a load or form a lateral barrier may be utilized. In addition, while the dimensions of the blocks discussed herein are preferably generally equal to those of the standard building blocks most commonly used in the industry, it is to be understood that the dimensions may be varied in that it is the overall configuration of the block which is of most importance.

Figure 1:
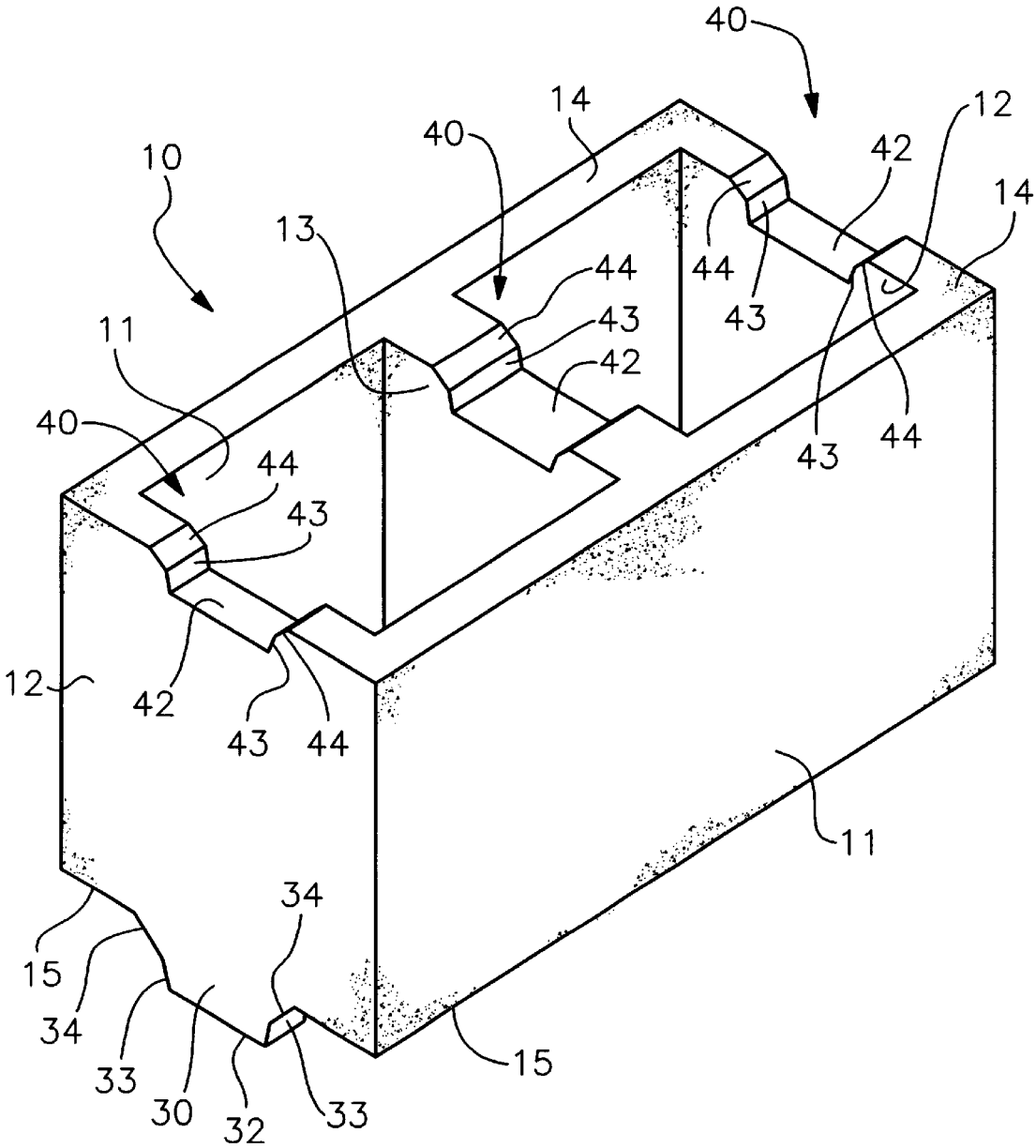
FIG. 1 is a perspective view of the standard block of the invention.
Figure 2:
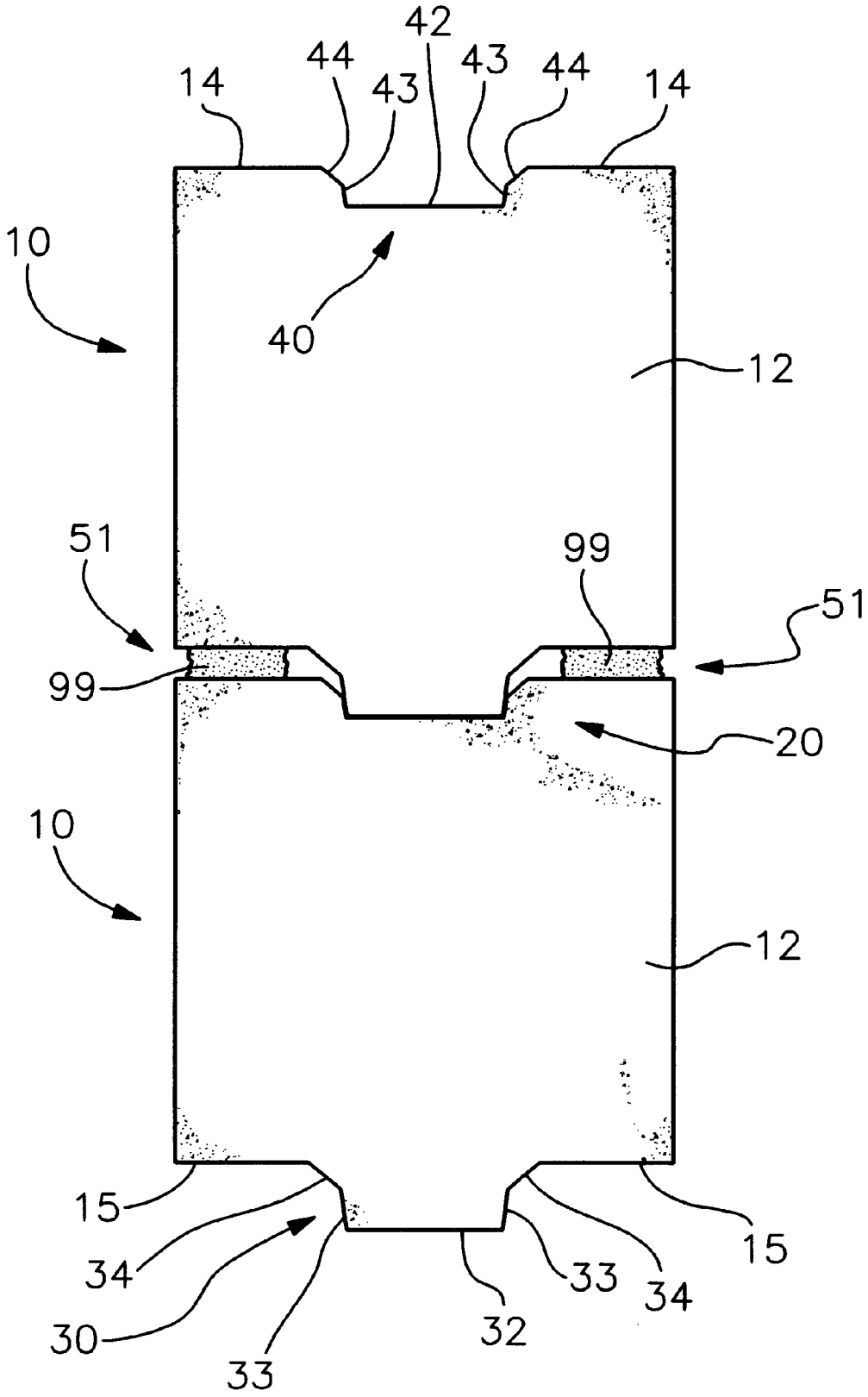
FIG. 2 is a top view of the standard block.
Figure 3:
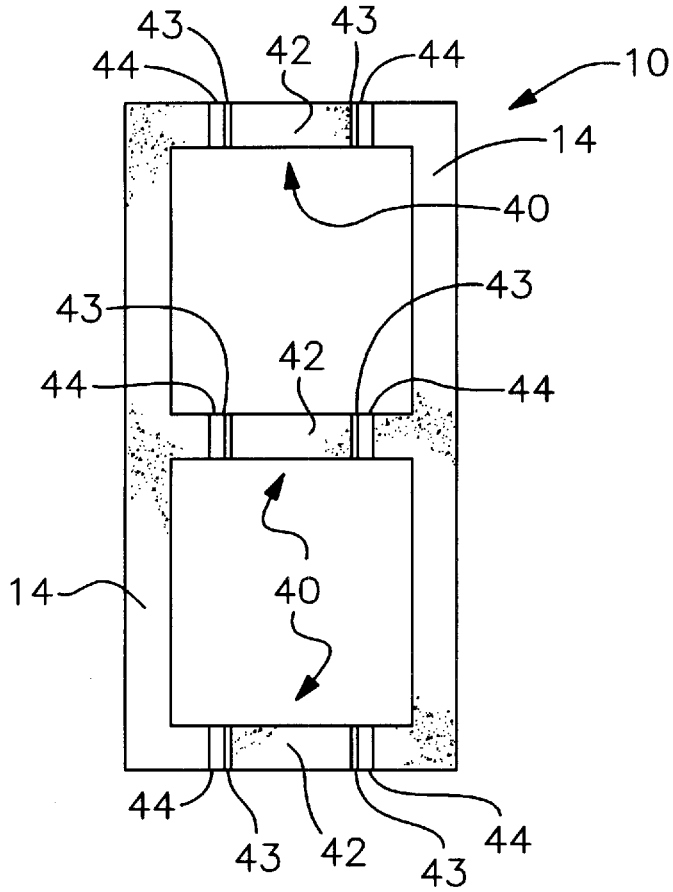
FIG. 3 is an end view showing a superior block seated on an inferior block.

The main block configuration is shown in FIGS. 1, 2 and 3, where the block 10 is seen to comprise a pair of opposing, parallel side walls 11, a pair of opposing, parallel end walls 12 joined at right angles to the side walls 11, and preferably a middle wall 13 extending perpendicularly between and joining the side walls 11 and centered at the midpoint between the end walls 12. The side walls 11 are generally rectangular in overall shape with a smooth or textured external surface. The blocks 10 have a pair of upper edges 14 and a pair of lower edges 15 extending from end wall 12 to opposing end wall 12 and partially in the lateral direction along the end walls 12 and the middle wall 13 to define a generally E-shaped configuration, with the upper and lower edges 14 and 15 preferably presenting flat surfaces for receipt of mortar 99. Suitable and common dimensions for the side walls 11 are about eight inches in height and about sixteen inches in length, with the outer distance between opposing side walls 11 being about eight inches, such that the dimensions of the exposed side walls 11, the thickness of the block 10 and the height of the block 10 are generally equal to the dimensions of commonly known building blocks. A wall thickness of about one inch for the side walls 11 and end walls 12 is suitable, with the middle wall 13 preferably having a larger thickness dimension of about two inches.

The block 10 is provided with alignment means 20 which acts to automatically align the block 10 in proper relation to the blocks 10 in the course below it. The alignment means 20 aligns the block laterally, such that the side walls 11 are parallel to the side walls of lower blocks 10. The alignment means 20 on a block 10 comprises tongue members 30 which extend beneath or form the lower portion of the end walls 12 and middle wall 13, and corresponding groove members 40 which occupy or form the upper portion of the end walls 12 and middle wall 13. The tongue members 30 and groove members 40 are disposed laterally between the lower edges 15 and upper edges 14, respectively. The tongue members 30 extend below the side walls 11.

The tongue members 30 each comprise a generally planar, horizontally disposed, tongue lower edge 32, a pair of opposing, outwardly inclined, first sloping side walls 33 joined to said lower edge 32, and a pair of opposing, outwardly inclined, second sloping side walls 34 extending between the first sloping side walls 33 and the generally horizontally disposed lower edges 15 of the side walls 11. The first sloping side walls 33 are more vertically oriented than the second sloping side walls 34. Most preferably, the first sloping side walls 33 slant outwardly approximately seven degrees relative to vertical, i.e., forming an interior angle of approximately 97 degrees relative to the lower edge 32. Suitable dimensions are a height of about 0.375 inches for the tongue first sloping side walls 33, a lateral width of about 0.046 inches for the tongue first sloping side walls 33, a height of about 0.375 inches for the tongue second sloping side walls 34, a lateral width of about 0.350 inches for the tongue second sloping side walls 34, and a lateral width of about 2.533 inches for the tongue lower edge 32. The overall height of the tongue member 30 is about 0.750 inches beyond the lower edges 15, each of which extend outward in the horizontal direction about 2.125 inches.

The groove members 40 each comprise a generally planar, horizontally disposed, groove bottom 42, a pair of opposing, outwardly inclined, first sloping side walls 43 extending upward from the groove bottom 42, and a pair of opposing, outwardly inclined, second sloping side walls 44 which extend between the first sloping side walls 43 and the generally horizontally disposed upper edges 14. The first sloping side walls 43 are more vertically disposed than the second sloping side walls 44. Suitable dimensions are a height of about 0.188 inches for the groove first sloping side walls 43, a width of about 0.023 inches for the groove first sloping side walls 43, a height of about 0.188 inches for the groove second sloping side walls 44, a width of about 0.188 inches for the groove second sloping side walls 44, and a lateral width of about 2.658 inches for the groove bottom 42. The overall depth of the recess member 40 is about 0.376 inches beneath the upper edges 14, which are each about 2.273 inches in lateral width. The lateral width of the tongue lower edges 32 and groove bottoms 42 are chosen such the tongue members 30 fit relatively snugly into the groove members 40 in mating manner such that relative lateral movement is precluded.

Figure 4:
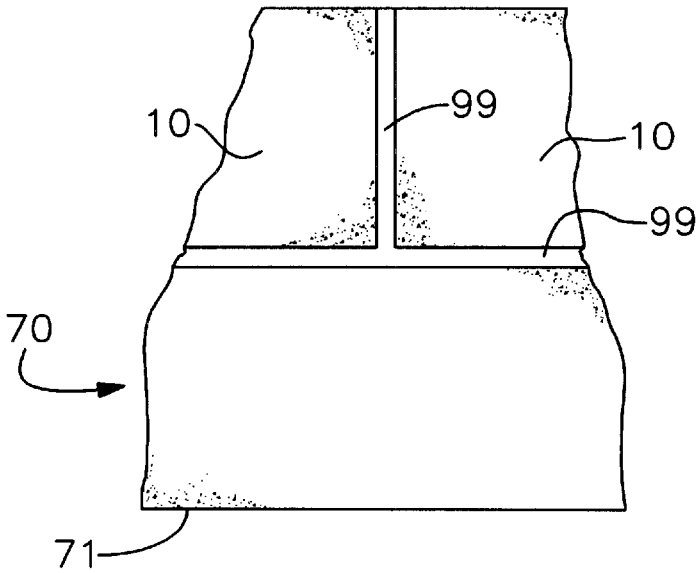
FIG. 4 is a side view showing a course of blocks seated on a starter block.

The tongue member 30 is of greater height than the depth of the groove member 40, as it is necessary that the tongue member 30 be longer in the vertical direction than the groove member 40 so that it will extend into the groove member 40 once mortar 99 is applied between the blocks 10. As shown, the tongue members 30 are preferably approximately twice the vertical dimension of the groove members 40. Because of this configuration, when a block 10 is placed onto a lower course of blocks 10, as shown in FIG. 4, only the first sloping side walls 33 of the tongue members 30 of the upper block 10 will contact the first sloping side walls 43 of the groove members 40 of the lower blocks 10. The excess length of the tongue members 33 maintains the tongue second sloping side walls 34 a short distance above and separated from the groove second sloping side walls 44 of the blocks 10 below, thereby creating interior chute recesses 51 of increasing separation in the outward direction between the blocks 10. Likewise, the excess length of the tongue members 30 maintains the lower edges 15 of the upper block 10 a short distance above the upper edges 14 of the lower blocks 10, thereby defining a joint recess 52 to receive the mortar 99. These features are important to account for excess or improperly applied mortar 99. To bond a block 10 to the lower course of blocks 10, mortar 99 is applied along the upper edges 14 of the lower blocks 10, as well as to the end wall 12 of the block 10 being laid which will abut the adjacent block 10 already positioned in the same course. When the block 10 is set onto the lower course of blocks 10 by aligning the tongue members 30 into the groove members 40, the block 10 is aligned properly in the lateral direction. Any excess mortar 99 will be pressed outward from the joint recesses 51 to be removed by hand or inward into the open area between the sloping walls 34 and 44. In addition, if any mortar 99 accidentally falls into the groove member 40, the conjunction of the first sloping side walls 33 and 43 and the conjunction of the second sloping side walls 34 and 44, the combinations defining an interior chute 52 which increases in separation distance in the outward direction, the mortar 99 will be displaced into the larger joint recess 51, which prevents the excess mortar 99 from interfering with the proper fit between the block 10 and the lower course of blocks 10, both vertically and horizontally, since the excess mortar 99 rests harmlessly within the joint recesses 51.

Unless the lowermost course of blocks 10 is set into wet concrete or cement, the system requires the use of starter blocks 70, as shown in FIG. 4, which have a flat lower edge 71 with no tongue members 30 extending beneath the block 10. The first course of a wall would consist of starter blocks 70 placed onto a flat support slab or floor. The remainder of the courses would consist of blocks 10 as described above.

Figure 5:
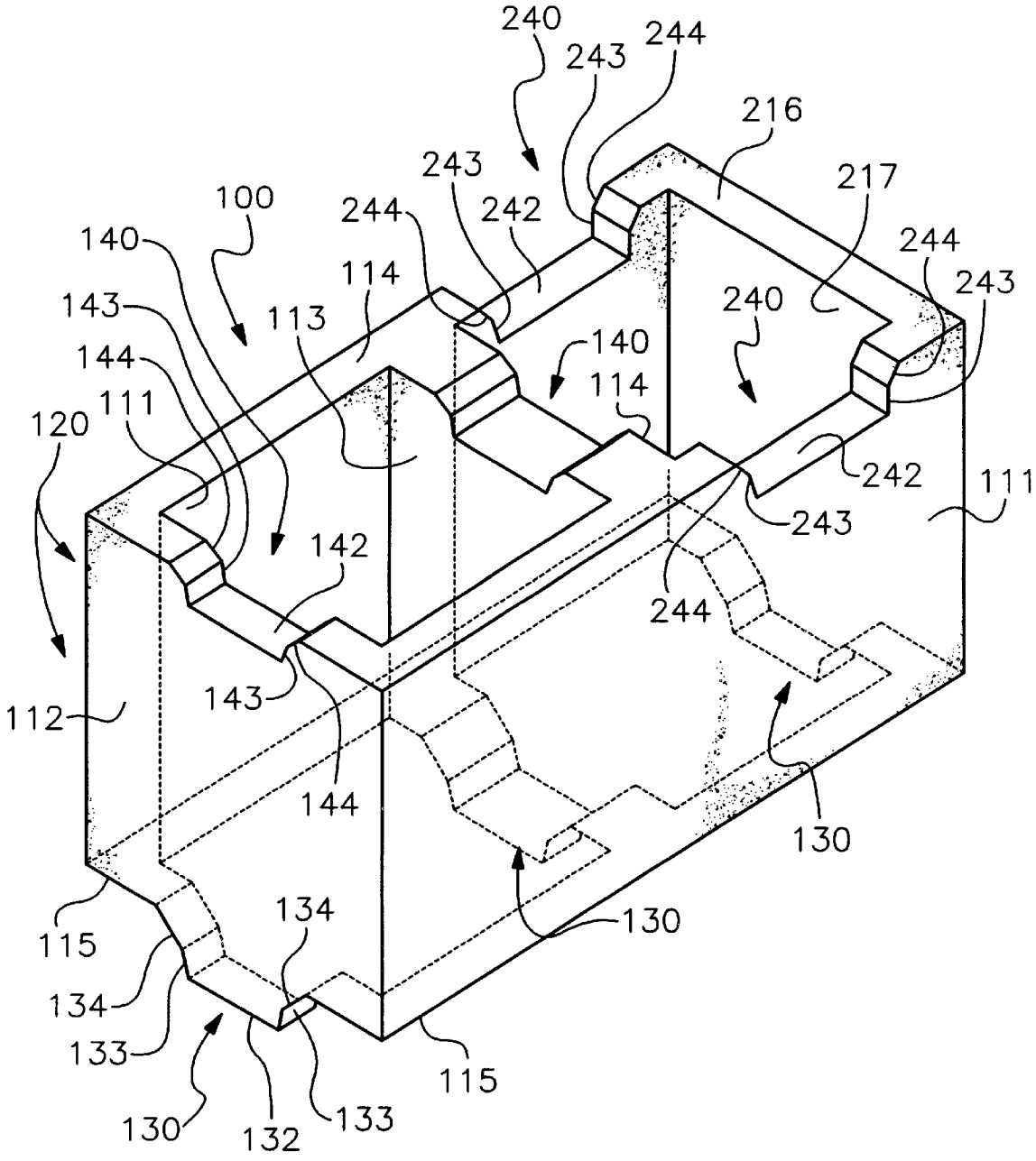
FIG. 5 is a perspective view of a corner block, with the occluded features shown in outline.

In order to provide a simple system for constructing corners using the blocks 10 as described above, corner blocks 100 as shown in FIG. 5 are provided. The corner blocks 100 have some features identical to the blocks 10. At what will be the interior end of the corner block 100, an interior end wall 112 is provided with alignment means 120 comprising a tongue member 130 comprising a lower edge 132, first sloping side walls 133, second sloping side walls 134, and a groove member 140 comprising a lower edge 142, first sloping side walls 143 and second sloping side walls 144. A middle wall 113 has equivalent tongue and groove members 130 and 140. Side walls 111 have upper edges 114 and lower edges 115. For half of the corner block 100, the interior half which will abut one of the standard blocks 10 in a particular course, these components are identical to the equivalent components of the block 10 as described in detail previously. The other half of the corner block 100 is configured much differently. The opposite end wall 217, which will be exposed to the exterior side of the corner, has a generally flat and planar upper lateral edge 216 which forms the lower boundary to receive mortar 99, while the lower portion of the exterior end wall 217 has a tongue member 130 comprising a tongue member 131 with a lower edge 132, first sloping side walls 133 and second sloping side walls 134, the projection member 130 being configured the same as the projection members 130 on the middle wall 113 and interior end wall 112.

A pair of opposing lateral groove members 240 are positioned on the upper edge 114 between the middle wall 113 and the exterior end wall 217, such that the side walls 111 of the corner block 100 do not present a rectangular perimeter. The lateral groove members 240 each comprise a lower edge 242, first sloping side walls 243 and second sloping side walls 244. The lateral groove members 240 are structured and dimensioned to match the other groove members 140 and 40, so that they can receive the projection members 130 in the same manner as regular blocks 10.

A corner is constructed by building a course with one corner block 100 positioned with the exterior end wall 217 disposed at the end of the course where the corner is to be formed. A standard block 10 is mounted at a right angle to the corner block 100, abutting it in normal manner. The upper course is laid by positioning a corner block 100, again with the exterior end wall 217 disposed at the end of the upper course, at a right angle to the lower corner block 100. This is accomplished by placing the tongue members 130 of the upper corner block 100 into the lateral groove members 240 of the lower corner block 100 and into the groove members 40 of the adjacent block 10 positioned in the same course as the lower corner block 100. The corner can be formed in either direction. The tongue member 130 of the exterior end wall 217 of the upper corner block 100 will align with the exterior lateral groove member 240 of the lower corner block 100. The tongue member 130 of the middle wall 113 of upper corner block 100 will align with both the interior lateral groove member 240 of the lower corner block 100 and the groove member 40 of the abutting end wall 12 of the lower block 10. The tongue member 130 of the interior end wall 112 of the upper corner block 100 will align with the groove member 40 of the middle wall 13 of the lower block 10. The upper lateral edge 216 of the lower corner block 100 extends beneath a portion of the lower edge 115 of the upper corner block 100 to form the recess to receive mortar 99. Each course is then formed by disposing the upper corner block 100 perpendicularly to the lower corner block 100.

It is understood that equivalents and substitutions to certain elements set forth above may be obvious to those skilled in the art, and the true scope and definition of the invention therefore is to be as set forth in the following claims.

I claim:

1. A building block comprising a pair of generally vertical side walls joined to a pair of generally vertical end walls, a generally vertical middle wall bridging said sides walls, a pair of generally horizontal upper edges, a pair of generally horizontal lower edges, and alignment means for aligning said block with other similar blocks such that said block is properly aligned in the lateral and vertical direction, said alignment means comprising tongue members and groove members which join in a mating manner, wherein said tongue members each comprise a generally horizontal tongue lower edge, a pair of opposing first sloping side walls connected to and sloping outwardly from said tongue lower edge, and a pair of opposing second sloping side walls connected to and sloping outwardly from said pair of first sloping side walls and connected to said block lower edges, wherein said first sloping side walls are more vertically oriented relative to said tongue lower edge than said second sloping side walls;

wherein said groove members each comprise a generally horizontal groove bottom, a pair of opposing first sloping side walls connected to and sloping outwardly from said groove bottom, and a pair of opposing second sloping side walls connected to and sloping outwardly from said first sloping side walls and connected to said block upper edge;

wherein the distance from said tongue lower edge to said block lower edge is greater than the distance from said groove bottom to said block upper edge.

2. The block of claim 1, where said tongue members and said groove members are each portions of said pair of end walls and said middle wall and are positioned between said pair of side walls.

3. The block of claim 2, wherein said tongue members are each a lower portion of said pair of end walls and said middle wall, and said groove members are each an upper portion of said pair of end walls and said middle wall.

4. The block of claim 1, wherein each of said pair of lower edges is longer than each of said pair of upper edges.

5. The block of claim 1, wherein each of said pair of side walls is approximately 8 inches by 16 inches and approximately 1 inch in thickness, where each of said end walls is approximately 8 inches wide and approximately 1 inch in thickness, where said tongue members extend approximately 0.75 inches below said pair of lower edges, and where said groove members extend approximately 0.375 inches below said upper edges.

6. The block of claim 5, wherein each of said tongue first sloping side walls is approximately 0.375 inches in height and approximately 0.046 inches in lateral width, each of said tongue second sloping side walls is approximately 0.375 inches in height and approximately 0.350 inches in lateral width, said tongue lower edge is approximately 2.533 inches in lateral width, and said lower edges are approximately 2.125 inches in lateral width adjacent said tongue member; and wherein each of said groove first sloping side walls is approximately 0.188 inches in height and approximately 0.023 inches in lateral width, each of said groove second sloping side wails is approximately 0.188 inches in height and approximately 0.188 inches in lateral width, said groove bottom is approximately 2.658 inches in lateral width, and said upper edges are approximately 2.273 inches in lateral width adjacent said groove member.

7. The block of claim 1, wherein each of said tongue first sloping side walls is inclined at an interior angle of approximately 97 degrees relative to said tongue lower edge.

8. A wall structure comprising multiple building blocks, where each of said blocks comprises a pair of side walls joined to a pair of end walls, a middle wall bridging said sides walls, a pair of generally horizontal, E-shaped upper edges, a pair of generally horizontal, E-shaped lower, and alignment means for aligning said blocks with each other such that said blocks are properly aligned in the lateral and vertical direction within said wall structure, said alignment means comprising tongue members and groove members, wherein said tongue members each comprise a generally horizontal tongue lower edge, a pair of first sloping side walls connected to and sloping outward from said tongue lower edge, and a pair of second sloping side walls connected to and sloping outwardly from said pair of first sloping side walls and connected to said block lower edges, wherein said first sloping side walls are more vertically oriented relative to said tongue lower edge than said second sloping side walls;

wherein said groove members each comprise a generally horizontal groove bottom, a pair of first sloping side walls connected to and sloping outwardly from said groove bottom, and a pair of second sloping side walls connected to and sloping outwardly from said first sloping side walls and connected to said block upper edge;

wherein the distance from said tongue lower edge to said block lower edge is greater than the distance from said groove bottom to said block upper edge such that when one of said blocks is positioned on top of another of said blocks said tongue lower edges abut said groove bottoms and whereby said tongue second sloping side walls and said groove second sloping side walls do not abut and thereby define interior chutes, and whereby said block upper edges and said block lower edges do not abut and thereby define joint recesses for the receipt of mortar to join said blocks.

9. The wall structure of claim 8, where said tongue members and said groove members are each portions of said pair of end walls and said middle wall and are positioned between said pair of side walls.

10. The wall structure of claim 9, where said tongue members are each a lower portion of said pair of end walls and said middle wall, and said groove members are each an upper portion of said pair of end walls and said middle wall.

11. The wall structure of claim 8, where each of said pair of side walls is approximately 8 inches by 16 inches and approximately 1 inch in thickness, where each of said end walls is approximately 8 inches wide and approximately 1 inch in thickness, where said tongue members extend approximately 0.75 inches below said block lower edges, and where said groove members extend approximately 0.375 inches below said upper edges.

12. The block of claim 11, wherein each of said pair of side walls is approximately 8 inches by 16 inches and approximately 1 inch in thickness, where each of said end walls is approximately 8 inches wide and approximately 1 inch in thickness, where said tongue members extend approximately 0.75 inches below said pair of lower edges, and where said groove members extend approximately 0.375 inches below said upper edges.

13. The block of claim 12, wherein each of said tongue first sloping side walls is approximately 0.375 inches in height and approximately 0.046 inches in lateral width, each of said tongue second sloping side walls is approximately 0.375 inches in height and approximately 0.350 inches in lateral width, said tongue lower edge is approximately 2.533 inches in lateral width, and said lower edges are approximately 2.125 inches in lateral width adjacent said tongue member; and wherein each of said groove first sloping side walls is approximately 0.188 inches in height and approximately 0.023 inches in lateral width, each of said groove second sloping side walls is approximately 0.188 inches in height and approximately 0.188 inches in lateral width, said groove bottom is approximately 2.658 inches in lateral width, and said upper edges are approximately 2.273 inches in lateral width adjacent said groove member.

14. The block of claim 8, wherein each of said tongue first sloping side walls is inclined at an interior angle of approximately 97 degrees relative to said tongue lower edge.

15. The wall structure of claim 8, further comprising multiple starter blocks, where each of said starter blocks comprises a pair of side walls joined to a pair of end walls, a middle wall bridging said sides walls, generally horizontal upper edges, a generally horizontal lower edge, and alignment means for aligning said starter blocks with said building blocks such that said building blocks are properly aligned in the lateral and vertical direction within said wall structure, said alignment means comprising recess members, wherein said groove members each comprise a generally horizontal groove bottom, a pair of first sloping side walls connected to and sloping outwardly from said groove bottom, and a pair of second sloping side walls connected to and sloping outwardly from said first sloping side walls and connected to said block upper edge;

wherein said starter blocks are positioned to define the lowest course of blocks in said wall structure, wherein the distance from said tongue lower edge to said block lower edge is greater than the distance from said starter block groove bottom to said starter block block upper edge such that when one of said blocks is positioned on top of one of said starter blocks said tongue lower edges abut said starter block groove bottoms and whereby said tongue second sloping side walls and said starter block groove second sloping side walls do not abut and thereby define interior chutes, and whereby said block upper edges and said starter block lower edges do not abut and thereby define joint recesses for the receipt of mortar to join said blocks.

16. The wall structure of claim 8, further comprising corner blocks, where each of said corner blocks comprises a pair of side walls joined to a pair of end walls, one said end wall being an exterior end wall and the other being an interior end wall, a middle wall bridging said sides walls, upper edges, lower edges, an upper lateral edge on said exterior end wall, and alignment means for aligning said corner blocks with each other and with said building blocks such that all said blocks are properly aligned in the lateral and vertical direction within said wall structure to form a right angle corner, said alignment means comprising tongue members and groove members, wherein said tongue members are positioned on said interior end wall, said middle wall and said exterior end wall and each comprise a generally horizontal tongue lower edge, a pair of first sloping side walls connected to and sloping outward from said tongue lower edge, and a pair of second sloping side walls connected to and sloping outwardly from said pair of first sloping side walls and connected to said block lower edges, wherein said first sloping side walls are more vertically oriented relative to said tongue lower edge than said second sloping side walls;

wherein two of said groove members each comprise a generally horizontal groove bottom, a pair of first sloping side walls connected to and sloping outwardly from said groove bottom, and a pair of second sloping side walls connected to and sloping outwardly from said first sloping side walls and connected to said block upper edge, wherein one said groove member is positioned on said interior end wall and the other is positioned on said middle wall;

wherein another two of said groove members are lateral groove members positioned on said upper edges between said middle wall and said exterior end wall, and wherein each of said lateral groove members each comprises a generally horizontal groove bottom, a pair of first sloping side walls connected to and sloping outwardly from said groove bottom, and a pair of second sloping side walls connected to and sloping outwardly from said first sloping side walls and connected to said block upper edge;

wherein the distance from said tongue lower edge to said block lower edge is greater than the distance from said groove bottom to said block upper edge such that when one of said corner blocks is positioned at a right angle on top of another of said corner blocks said tongue lower edges at said exterior end wall and said middle wall abut said groove lower edges in said lateral recess members and whereby said tongue sloping walls and said groove sloping walls do not abut and thereby define interior wall recesses, and whereby one of said pair of lower longitudinal edges does not abut with said upper lateral edge and thereby partially define a pair of longitudinal joint recesses, and whereby said tongue lower edges at said interior wall and said middle block abut said groove lower edges in one of said end walls and said middle wall of one of said building blocks and whereby said tongue sloping walls and said groove sloping walls do not abut and thereby define interior wall recesses.

* * * * *